US005475934A

United States Patent [19]

Eskelinen et al.

[11] Patent Number: 5,475,934

[45] Date of Patent: Dec. 19, 1995

[54] METHOD AND DEVICE FOR ENSURING THE RUN OF THE WEB IN THE MULTI-CYLINDER DRYER OF A PAPERMACHINE

[75] Inventors: Pekka Eskelinen, Kotka; Timo Haverinen, Masku, both of Finland

[73] Assignee: Valmet Paper Machinery, Inc., Helsinki, Finland

[21] Appl. No.: 318,879

[22] PCT Filed: Feb. 19, 1993

[86] PCT No.: PCT/FI93/00058

§ 371 Date: Oct. 18, 1994

§ 102(e) Date: Oct. 18, 1994

[87] PCT Pub. No.: WO94/19536

PCT Pub. Date: Sep. 1, 1994

[51] Int. Cl.[6] ..... D21F 5/04; F26B 3/04

[52] U.S. Cl. ..... 34/455; 34/117; 34/454

[58] Field of Search ..... 34/117, 455, 456

[56] References Cited

U.S. PATENT DOCUMENTS

| | | | |
|---|---|---|---|
| 3,376,653 | 4/1968 | Doane | 34/455 |
| 3,733,711 | 5/1973 | Haythornwaite | 34/23 |
| 3,753,298 | 8/1973 | Ely . | |
| 3,816,941 | 6/1974 | Holik et al. . | |
| 4,516,330 | 5/1985 | Eskelinen et al. | 34/23 |
| 4,891,891 | 1/1990 | Wedel | 34/23 |
| 4,899,463 | 2/1990 | Heikkila et al. . | |
| 5,325,608 | 7/1994 | Mayer | 34/114 |

FOREIGN PATENT DOCUMENTS

| | | |
|---|---|---|
| 68279 | 4/1985 | Finland . |
| 76142 | 5/1988 | Finland . |
| 2212209 | 3/1972 | Germany . |

*Primary Examiner*—Henry A. Bennett
*Assistant Examiner*—Dinnatia Doster
*Attorney, Agent, or Firm*—Pollock, Vande Sande & Priddy

[57] ABSTRACT

The multi-cylinder dryer of a papermachine includes a first tier of cylinders, where the web supported by a first dryer wire travels on the cylinders of the first tier of cylinders, as well as a second tier of cylinders, where the web supported by a second dryer wire travels on the cylinders of the second tier of cylinders. The first dryer wire travels from a cylinder of the first tier of cylinders to a first guide roll and delivers the web lying on its side facing the cylinder of the first tier onto the second dryer wire and, after having wound onto a second wire guide roll, again takes up, on its surface facing the following cylinder of the first tier, the web from the second dryer wire traveling through the second tier of cylinders. A section extending between the dryer cylinder and the first wire guide roll is provided on the web-free side of the wire with a nozzle for blowing air in the traveling direction of the wire into a gap between the wire and the first wire guide roll for producing a plenum zone facilitating the release of the web.

10 Claims, 3 Drawing Sheets

METHOD AND DEVICE FOR ENSURING THE RUN OF THE WEB IN THE MULTI-CYLINDER DRYER OF A PAPERMACHINE

FIELD OF THE INVENTION

The present invention relates to a method for ensuring the run of the web in the multi-cylinder dryer of a papermachine, The invention relates also to a device for carrying out the above method.

BACKGROUND OF THE INVENTION

The multi-cylinder dryers of a papermachine have employed a so-called twin-wire run at the downstream end of a drying section. In the twin-wire run, the wire is supported against the jackets of cylinders included in two tiers of cylinders by means of two wires, one running along a tortuous path against the jackets of the cylinders of the upper tier and the other against the jackets of the cylinders of the lower tier. When passing over from one tier of cylinders to the other, the web travels unsupported. At machine speeds of more than 800 m/min, the air currents produced by the web and moving parts of the machine cause fluttering of the web in these free spaces. The fluttering leads to web breakups at the upstream end of such cylinder groups, as the strength properties of the web are still poor due to a high water content.

Efforts have been made to resolve this problem by means of a single-wire passage, wherein the free runs of the web are eliminated and the latter travels and is supported all the time by one and the same dryer wire between the cylinders included in two tiers. The drying effect of the cylinders of the same tier, whereat the wire lies between the web and the cylinder, is negligible as the wire prevents the transfer of heat from the cylinder to the web. Indeed, in the most recent machines, such cylinders have been replaced with suction rolls which has resulted in further improved machine operating characteristics and the threading ropes have become unnecessary.

Originally, the single-wire groups generally used to comprise just two or three first drive groups of a machine, but their number has been increased as the machine speeds have increased. Some recent machines completely lack the twin-wire cylinder groups. A drawback in a single-wire run is the increased length of the dryer section, leading to the increased length of the machine hall and, thus, to the increased factory building costs. On the other hand, a drawback affecting the grade of paper is that, in a single-wire run, heat is always supplied to a web from the same side of paper with possible defects developing in paper (curling).

As a summary of the above alternatives it can be said that the benefits of the twin-wire run include two-sided drying and a short dryer section but the drawbacks include poorer running characteristics at high machine speeds. The advantages and disadvantages of the single-wire run are essentially opposite relative to the above.

In addition, for example, U.S. Pat. No. 3,753,298 discloses a machine configuration, which employs a twin-wire run but in which the web is all the time supported by either one of the dryer wires. This is effected by passing the dryer wires by way of guide rolls mounted between the dryer cylinders in such a manner that, during the passage between a dryer cylinder and a guide roll, a dryer wire always in runs tangentially to the other guide roll and the other dryer wire wrapping therearound, whereby the web can be transferred from one dryer wire to another one at these points without free draws. A weakness of the solution disclosed in the cited publication is that the run of the web against the dryer wire between the dryer cylinders and wire guide rolls is not secured. Thus, the pressure differences prevailing in pockets defined by dryer cylinders and wire sections, the air currents produced thereby and, on the other hand, the adhesion forces between the web and cylinder surfaces detach the web from the dryer wire. Thus, the open, unsupported web is again susceptible to wrinkling and, at sufficiently high running speeds, this again leads to web breakups.

Naturally, attempts have been made to improve the operating characteristics of such a machine configuration by providing such multi-cylinder dryers at suitable locations with air-current controlling and/or producing structures. This type of solutions have been disclosed for example, in Finnish Patents 68279 (Patent application 841167) and 76142 (Patent application 854494). The passage of the web against the dryer wire is secured by using vacuum developing blow boxes. However, the blow box assemblies and nozzle designs proposed in the above references require quite large overall air quantities for a desired effect. These air quantities are typically about 2000–2400 $m^3$/hm per pocket. In terms of energy efficiency, this is undesired and leads to very large diameters in compensation air manifolds as well as highly sophisticated and expensive air circulation systems.

A design with a slightly different machine configuration from those described above is proposed in German patent 2,212,209, wherein open runs are eliminated by arranging each dryer wire to travel between the cylinders around a plurality of rolls, whereby the web always is transferred from a section, wherein it travels supported by the wire between a cylinder and the first wire guide roll, to a section wherein the second wire travels between the last wire guide roll and a cylinder included in the second tier. The transfer of the web from one dryer wire onto another is by no means secured and, especially at high machine speeds, the web may be disengaged from the dryer wire surface through the action of the above factors with the above-mentioned harmful consequences.

SUMMARY OF THE INVENTION

An object of the present invention is to provide an improvement for the above drawbacks and to introduce a method and a device for ensuring the run of the web in the multi-cylinder dryer of a papermachine, wherein the web travels on the dryer wires and will be transferred from wire to wire without problems while using simple arrangements. In order to achieve this object, a method of the invention within a section between a dryer cylinder and the first wire guide roll, air is blown by means of a nozzle from the side of the wire uncovered by the web, whereby over-pressure is developed in the gap between the wire guide roll and the wire for facilitating separation of the web from the wire. On the other hand, a device of the invention is characterized in that a section between a dryer cylinder and the first wire guide roll is provided with air blowing means on the side of the wire free from the web, comprising a nozzle directed in the wire traveling direction in order to secure the separation of the web from the wire by virtue of an over-pressurized gap between the wire guide roll and the wire.

The invention will now be described in more detail with reference made to the accompanying drawings, in which

BRIEF DESCRIPTION OF THE DRAWINGS

FIGS. 1 and 2 illustrate a multi-cylinder dryer, comprising a first tier of cylinders, wherein a web W is supported by a first dryer wire k1 and travels on cylinders 1 of the first tier of cylinders, as well as a second tier of cylinders parallel to the first tier but lying in another plane, wherein the web is supported by a second dryer wire k2 and travels around cylinders 2 of the second tier of cylinders. The first dryer wire k1 runs between two cylinders 1 of the first tier of cylinders in such a manner that it travels around two wire guide rolls, a first wire guide roll h1 and a second wire guide roll h2. Similarly, between the cylinders 2 of the second tier of cylinders the second dryer wire k2 travels around two wire guide rolls, a first wire guide roll h1 and a second wire guide roll h2. Thus, the transfer point of the web W within each section between the cylinders 1 and 2 of different tiers of cylinders is created at two adjacent wire guide rolls, one of which is always the first wire guide roll for a wire loop running between the cylinders of the same tier of cylinders and the other is the second wire guide roll for a wire loop running between the cylinders of the opposite tier of cylinders.

FIG. 1 shows a dryer, wherein the first wire k1 separates from the cylinder 1 of the first tier together with the web W at point a and progresses to the wire guide roll h1. The arrival point of the wire on the roll is designated with character c. Thereafter, the wire k1 winds under the guidance of the roll h1 towards the second wire guide roll h2 adjacent to the next cylinder 1 of the first tier of cylinders. The wire separation point from the first wire guide roll is designated with character d and its arrival point on the second wire guide roll is designated with character e. The web W is supported by the dryer wires against the cylinder jackets and, thus, upon separation from the cylinder at point a, it lies on the dryer wire surface facing the cylinder. Between point a and the first wire guide roll h1 on the other, web-free side of the dryer wire k1 is placed an air blow box 3, having its wire-facing wall provided with a nozzle s2 directed in the wire traveling direction. The nozzle is used for blowing air in the wire traveling direction and into a gap between the wire and the jacket of the wire guide roll h1 for developing therein a plenum zone n+ as a result of air blowing. The point where the flow of air from the nozzle takes places into a space between the wire and the wall of the blow box 3 is designated with character b and this can be conceived as the beginning of the plenum zone n+, extending all the way to the gap. Since the wire is pervious to air, the plenum zone n+ causes the separation of the web W from the wire k1 over a section b - c, the former progressing as an open run to the dryer wire k2 traveling on the second tier of cylinders at a point where the dryer wire travels upon the second wire guide roll h2 of a wire loop between two successive cylinders 2 of the second tier of cylinders. The arrival point of the web W on the second dryer wire is designated with character f. At point g downstream of point f, the dryer wire k2 separates from the wire guide roll h2 and thereafter supports web W over free section, wherein web W travels upon the surface of the dryer wire k2 facing the cylinder 2 and arrives upon the jacket of the dryer cylinder 2 at point h. After running around the dryer cylinder jacket under the dryer wire k2, it departs again from the cylinder at point a and its run from the cylinder 2 of the second tier of cylinders onto the cylinder 1 of the first tier of cylinders is similar to the above-described run from the cylinder 1 of the first tier of cylinders onto the cylinder 2 of the second tier of cylinders.

Figure 1:
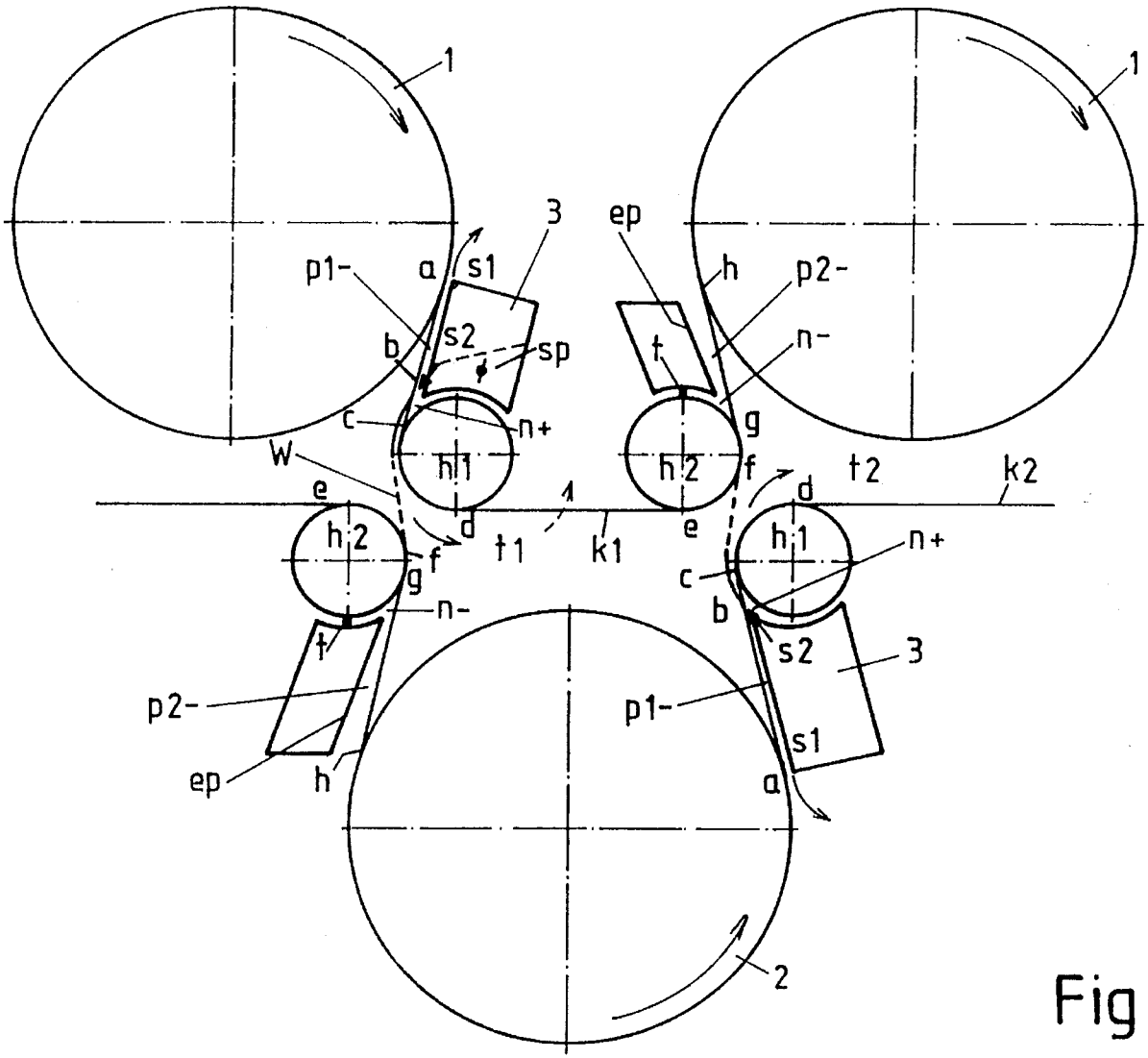
FIG. 1 shows a side view of a multi-cylinder dryer for a papermaking machine, wherein transfer points include free web runs and wherein the present invention is applied.

The distance of point b from point c is preferably 25–100 mm upstream. In order to secure the web run upon the dryer wire k1 through the section a - b, the air blow box 3 is provided with a nozzle s1, located roughly at point a and directed against the wire traveling direction. Thus, the air flow coming from the nozzle s1 and directed against the wire traveling direction produces within the section a - b a vacuum zone p1–, which is limited by the web-free surface of the wire and which is limited on the other side by the wire-facing wall of the blow box 3. The vacuum zone provides a good retention of the web W upon the dryer wire k1 by sucking the web against the latter from the opposite side as a result of the fact that the wire is substantially more pervious to air than the web W.

The next section g - h downstream of the free web run and the wire guide roll h2 is provided with a vacuum zone p2– limited by the wire, again on the web-free side of the second dryer wire k2. The vacuum zone is produced by means of a special ejector surface ep, which is formed of the surface of an air guiding box facing towards the section between the wire guide roll and dryer cylinder. The vacuum is created within the zone due to the fact that, when moving at a high speed, the dryer wire k2 carries air therealong away from a wider area of the wire and the surface. The vacuum sucks the web W located on the other side into contact with the wire identically to the action of the vacuum zone p1– over the section a - b. Surface ep forms with the wire preferably an angle of 0°–15° , opening towards the wire traveling direction. The vacuum zone p2– extends towards the roll h2 up to a gap located at the separation point g of the wire k2, and this zone is designated with character n–. To the end of the ejector surface ep next to the roll joins an arched surface facing the roll jacket, and between this surface and the roll jacket is fitted a sealing t for preventing the access of air into the underpressurized gap n–. This provides its own contribution to the vacuum zone prevailing with the section g - h.

The corresponding air blow box 3 and ejector surface ep are also provided over the next section between the tiers of cylinders downstream of the second tier dryer cylinder 2, within which section web W is transferred once again from the second dryer wire k2 onto first dryer wire k1 through the wire guide rolls h1 and h2.

The blow nozzle s2 at point b in fact has two functions, namely it serves as an ejector nozzle creating underpressure over the section a - b and it increases the overpressure in the wedge-shaped gap between the first dryer wire and the first wire guide roll h1 of the wire loop. While causing the separation of the web W from the wire, the plenum zone also works its way through a space between the web W and the dryer wire k1 winding around the wire guide roll h1 into a pocket t1, which is formed between a free section d - e of the dryer-wire extending between the wire guide rolls h1 and h2 and the free jacket of the cylinder 2 of the opposite tier of cylinders, and which is confined in the longitudinal direction of the dryer at opposite ends by a section of the second dryer wire k2 arriving on the dryer cylinder 2 and a section of the second dryer wire k2 departing therefrom. This provides for ventilation of the pocket confined by the free jacket of the dryer cylinder and the web W, which is important in a dryer section. Naturally, similar ventilation occurs in a pocket t2 formed between the second dryer wire k2 and the cylinder 1 of the first tier.

Figure 2:
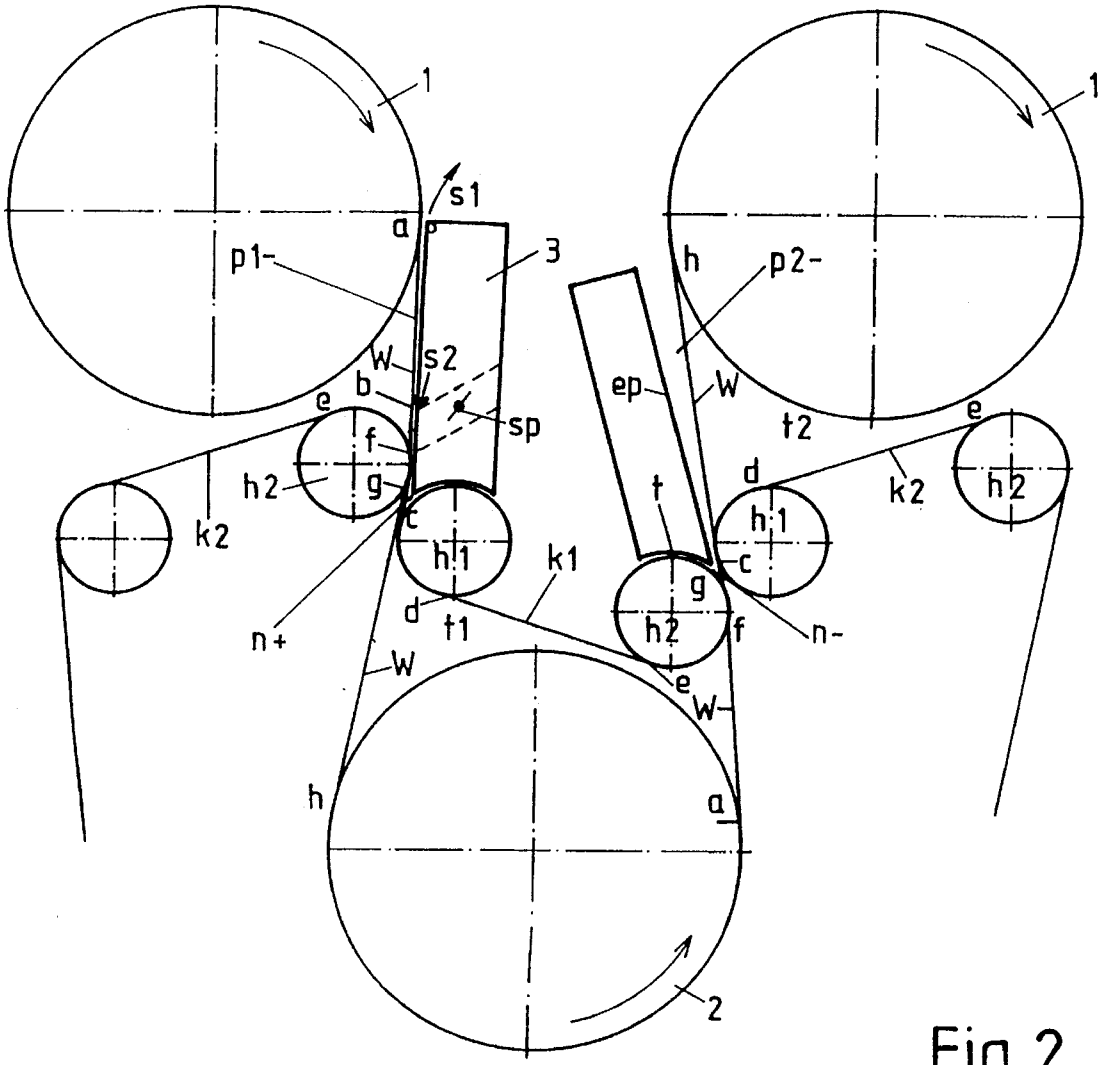
FIG. 2 shows a multi-cylinder dryer for a papermaking machine, wherein the web is supported by both wires at transfer points and wherein the present invention is applied.

FIG. 2 uses the same reference characters as FIG. 1 and illustrates another multi-cylinder dryer suitable for applying the invention. This embodiment does not include free sections of the web W due to the fact that, over the section a - c between the cylinder 1 and the first wire guide roll, the first dryer wire k1 is in contact, with the web W therebetween, with the second dryer wire k2 at point f, where the wire k2 winds along the second wire guide roll h2 of the wire loop. At the same time, this point is the arrival point of the web W on the second dryer wire k2. After having wound over a small sector on the second dryer wire k2 winding on the second wire guide roll h2 with the web W between the wires, the first dryer wire k1 separates from the wire k2 and leaves the web W on the second dryer wire which together with the web W separates from the wire guide roll h2 at point g and progresses as a free run to the dryer cylinder 2 of the second tier.

On the other hand, the passage of the web W from the second tier cylinder to the first tier cylinder is effected by means of a transfer between the second dryer wire k2 and first dryer wire k1. By adjusting the position of the rolls it is of course possible to control the distance over which the wires k1 and k2 travel together on the wire guide roll and the web-releasing wire may just run as a tangent to the run of the web-receiving wire on the wire guide roll. It is also possible that the wires do not come into contact with each other until at the point where the first dryer wire k1 winds on the first wire guide roll h1. The wires may also travel together, with the web therebetween, along the section between both rolls. In this alternative, in which the section between the rolls is impervious to air (the right-hand side of FIG. 2), the blowing by means of the nozzle s1 is not employed.

Over the section a - c in FIG. 2 on the web-free side of the dryer wire k1 there is an air-blow box similar to that in the embodiment of FIG. 1 for producing a or plenum zone n+ extending into the gap between the wire and the wire guide roll h1. The plenum zone commencing point b, at which nozzle s2 is located, lies upstream of the wires, meeting point f, preferably 25–100 mm upstream thereof, and the plenum zone extends in the traveling direction of the web W up to point c. Thus, the over-pressure is able to act through the wire k1, commencing from a point upstream of point c at which the wire k1 separates from the wire k2, that is over the free wire section between the separation point and point c, the plenum zone secures the transfer of the web W at separation point onto the second dryer wire k2 as well as its retention against it afterwards. The box 3 is also provided with a nozzle s1 operating the same way as in the embodiment of FIG. 1.

Over the section g - h on the web-free side of the second dryer wire 2 there is a corresponding ejector surface ep, having the functions as in FIG. 1.

The above-described nozzles s1 and s2 may be slit orifices covering the entire width of the web. In all embodiments, the blow box 3 and ejector surface ep can also be provided with edge blow nozzles mounted at the edge areas of the wires for preventing the diffusion of air leaks from the sides into vacuum zones p1–, p2– and n–.

Figure 3:
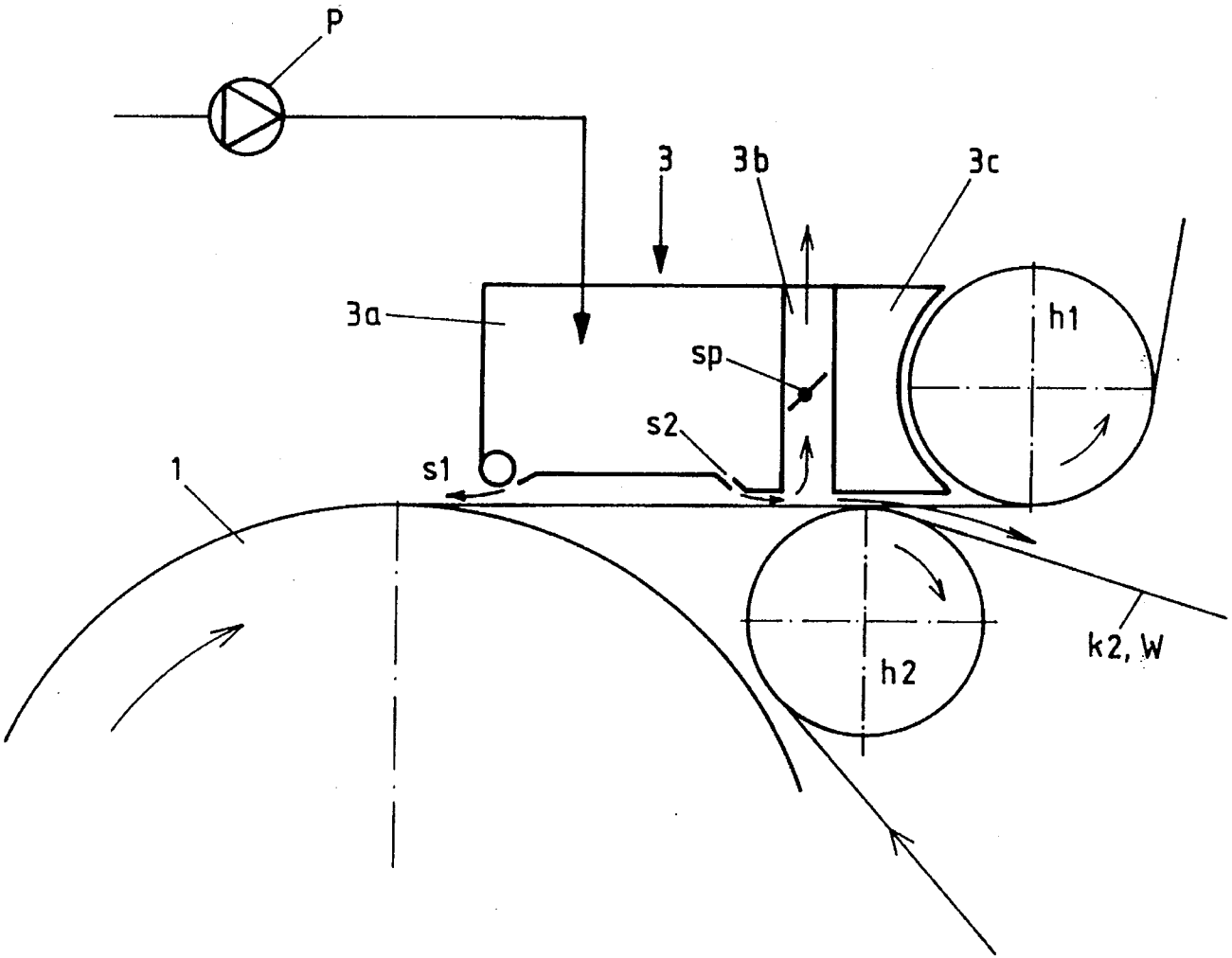
FIG. 3 is a schematic view of a blow box for use in the present invention.

In order to adjust the pocket ventilation effect as well as the underpressures and overpressures, the blow box can be divided in blocks. FIG. 3 illustrates in more detail the construction and operation of a blow box 3 shown in FIG. 2. The entire amount of air to be blown travels from a fan P into a chamber 3*a* of a stabilizer, from which it is branched in the lateral direction of the web to nozzles s1 and s2. Downstream of the nozzle s2 in the web traveling direction there is an outwardly open gap 3*b*, extending across the box and away from the web and provided with flow-regulating elements, such as dampers sp. When the damper sp is open, some of the blow air received in the box is allowed to flow away between the chamber 3*a* and wire guide roll h1 along gap 3*b* instead of penetrating through wire k1 into pocket t1. When damper sp is closed, all the air coming from the nozzle s2 is forced to flow through the dryer wire for a more effective pocket ventilation and pressure action. The gap 3*b* can be provided in the lateral direction of the web with a plurality of dampers for regulating the distribution of air in the lateral direction by varying the positions of said dampers.

The gap 3*b* is followed at the end next to the wire guide roll h1 by a sealing part 3*c*, whose function is to direct the air current of the nozzle s2 into the pocket t1. The construction of the box 3 shown in FIG. 1 is otherwise identical but the gap 3*b* is formed between the chamber 3*a* and the wire guide roll h1 and it does not have a separate sealing part 3*c*.

We claim:

1. A method for ensuring the run of the web in the multi-cylinder dryer of a papermachine, including a first tier of cylinders where the web travels supported by a first dryer wire on the cylinders of said first tier of cylinders, and a second tier of cylinders where the web travels supported by a second dryer wire on the cylinders of said second tier of cylinders, said first dryer wire traveling between one cylinder and the following cylinder of the first tier of cylinders by advancing from the cylinder of said first tier to a first wire guide roll, whereby, over a first section which commences at the first separation point of the first dryer wire from the cylinder of said first tier and ends at the second wire separation point from the first wire guide roll, it delivers the web carried on its side facing the cylinder of the first tier over to said second dryer wire and, after the following section free from web, said first dryer wire winds around a second wire guide roll onto the following cylinder of the first tier, whereby, over a second section which commences at the arrival point of the first dryer wire on said second wire guide roll and ends at the arrival point of the first dryer wire on said following cylinder of the first tier, it takes up said web again, on its surface facing said cylinder of said first tier, from said second dryer wire traveling through the second tier of the cylinders, wherein a third section between the cylinder of said first tier and the first wire guide roll is provided with a first nozzle on the web-free side of the first dryer wire for blowing air in the traveling direction of the first dryer wire into a gap between the first dryer wire and the first wire guide roll for producing a plenum zone (n+) facilitating the release of the web.

2. A method according to claim 1, wherein upstream of said first nozzle in the traveling direction of the first dryer wire a second nozzle is provided for blowing against the traveling direction whereby a first vacuum zone (p1–) limited by the first dryer wire is formed between said first and second nozzles within the section between the dryer cylinder of said first tier and the first wire guide roll.

3. A method according to claim 1, wherein within at least one of fourth section of the first dryer wire extending between the second wire guide roll and said following dryer cylinder of the first tier and within the fourth section of the second dryer wire extending between the second wire guide roll and the cylinder of the second tier of cylinders and located in the web traveling direction downstream of the web arrival point on said second dryer wire is formed a second vacuum zone limited by said first and second dryer wire by means of an ejector surface lying opposite to said wire section.

4. A method according to claim 3, wherein said second vacuum zone is closed at the end next to said second wire guide roll by means of a sealing fitted between a surface adjoining the ejector surface and the jacket of said second wire guide roll.

5. A device for ensuring the run of the web in the multi-cylinder dryer of a papermachine, comprising a first tier of cylinders having a first dryer wire for supporting the web at and between the cylinders of said first tier of cylinders, and a second tier of cylinders having a second dryer wire for supporting said web at and between the cylinders of said second tier of cylinders, whereby, between one cylinder of the first tier and the following cylinder of the first tier of cylinders, said first dryer wire is passed around a first and second wire guide roll in a manner such that the web run between the cylinder of the first tier and the first wire guide roll includes a first section within which said web travels on the wire surface facing the cylinder of the first tier and which includes the release point of the web from the first dryer wire for its transfer onto the second dryer wire traveling on the cylinders of the second tier of cylinders, and a loop formed by the first dryer wire between said one cylinder and the following cylinder of the first tier of cylinders includes a second wire guide roll, around which said first dryer wire is passed to the following cylinder of the first tier, whereby a second section which commences at the wire arrival point on said second wire guide roll and ends at the arrival point of the first dryer wire on the cylinder of the first tier, includes the take-up point of the web onto the first dryer wire from said second dryer wire, wherein a third section extending between the dryer cylinder of the first tier and said first wire guide roll is provided on the side of the first dryer wire free from the web with air blow means, comprising a first nozzle directed in the wire traveling direction for releasing the web from the first dryer wire.

6. A device according to claim 5, wherein upstream of said first nozzle in the traveling direction of the first dryer wire there is a second nozzle, which is directed against the wire traveling direction for producing between the first and second nozzles a first vacuum zone limited by the first dryer wire.

7. A device according to claim 6, wherein between the first and second nozzles there is a surface facing the free section between the dryer cylinder of the first tier of cylinders and the first wire guide roll, said first vacuum zone being created between the surface and the wire section.

8. A device according to claim 7, wherein the surface is formed by the wall of an air blow box facing said first dryer wire, said air blow box including said first and second nozzles.

9. A device according to claim 5, wherein a section extending between the second wire guide roll and the following dryer cylinder of the first tier and the fourth section of the dryer wire extending between the second wire guide roll and the cylinder of the second tier of cylinders and located in the web traveling direction downstream of the web arrival point on said second dryer wire is provided on the side of one of the first and second wires free from the web with an ejector surface lying opposite to said wire section as well as with a second vacuum zone immediately limited by one of the wires within this section and at the ejector surface.

10. A device according to claim 9, wherein said second vacuum zone is closed at the end next to the second wire guide roll by means of a sealing fitted between a surface adjoining said ejector surface and the jacket of said second wire guide roll.

* * * * *